United States Patent [19]

O'Handley et al.

[11] 4,268,325

[45] May 19, 1981

[54] MAGNETIC GLASSY METAL ALLOY SHEETS WITH IMPROVED SOFT MAGNETIC PROPERTIES

[75] Inventors: Robert C. O'Handley, Bedford Hills, N.Y.; Michael O. Sullivan, Bloomfield, N.J.

[73] Assignee: Allied Chemical Corporation, Morris Township, Morris County, N.J.

[21] Appl. No.: 5,045

[22] Filed: Jan. 22, 1979

[51] Int. Cl.[3] ..... C21D 1/04

[52] U.S. Cl. ..... 148/108; 148/31.55

[58] Field of Search ..... 148/103, 108, 31.55, 148/31.57

[56] References Cited

U.S. PATENT DOCUMENTS

| | | | |
|---|---|---|---|
| 3,845,805 | 11/1974 | Kavesh | 164/89 |
| 3,856,513 | 12/1974 | Chen et al. | 75/122 |
| 3,862,658 | 1/1975 | Bedell | 164/429 |
| 3,881,540 | 6/1975 | Kavesh | 164/429 |
| 4,033,795 | 7/1977 | Berry et al. | 75/123 D |
| 4,077,462 | 3/1978 | Bedell et al. | 164/429 |
| 4,116,728 | 9/1978 | Becker et al. | 148/108 |
| 4,126,287 | 11/1978 | Mendelsohn et al. | 148/31.55 |
| 4,126,494 | 11/1978 | Imamura et al. | 148/31.57 |
| 4,152,486 | 5/1979 | Imamura et al. | 148/31.55 |

OTHER PUBLICATIONS

English translation of Japanese Kokai patent publication No. 51-73923, published Jun. 26, 1976, application No. 50-1508.

F. E. Luborsky et al., IEEE Transactions on Magnetics, vol. Mag. 11, 1644 (1975).

F. E. Luborsky et al., Rapidly Quenched Metals, Eds. N.J., Grant and B. C. Giessen (MIT Press, Cambridge, Mass. 1976), p. 467.

*Primary Examiner*—L. Dewayne Rutledge
*Assistant Examiner*—John P. Sheehan
*Attorney, Agent, or Firm*—Ernest Buff; Gerhard H. Fuchs

[57] ABSTRACT

A magnetic glassy metal alloy sheet is annealed at elevated temperature in a first magnetic field oriented in a direction substantially normal to the plane of the sheet. A second anneal may be performed in a weaker magnetic field in a direction substantially normal to the first field to minimize AC hysteresis losses. The annealed magnetic glassy metal alloy sheet has improved soft magnetic properties such as low hysteresis losses and may be used for transformer cores and the like.

15 Claims, 4 Drawing Figures

MAGNETIC GLASSY METAL ALLOY SHEETS WITH IMPROVED SOFT MAGNETIC PROPERTIES

FIELD OF THE INVENTION

The present invention relates to a process for annealing magnetic glassy metal alloy sheets in magnetic fields and to the magnetic materials obtained thereby.

BACKGROUND OF THE INVENTION

Glassy metal alloys have demonstrated attractive soft ferromagnetic properties for various applications. Such soft magnetic materials can be employed as parts for relays, for AC generators, for transformers, motors, magnetic amplifiers, mechanical rectifiers, storage cases, switching cores, active and passive transducers, magnetostrictive vibrators, telephone membranes, electromagnetic pole pieces, magnetic tape recorder heads, magnetostatic shields, as a powder for mass cores, as modulators, and as transmitters.

F. E. Luborsky et al. in IEEE Transactions on Magnetics, Vol. Mag 11, 1644 (1975) disclose poor response of DC characteristics of toroids to magnetic annealing.

F. E. Luborsky et al. in Rapidly Quenched Metals, Eds. N. J. Grant and B. C. Giessen (MIT Press, Cambridge, Mass. 1976) p. 467 disclose that stress relief and certain magnetic annealings change the direct current magnetic properties of glassy $Fe_{40}Ni_{40}P_{14}B_6$ alloy ribbon.

Becker et al. in U.S. Pat. No. 4,116,728 disclose the annealing of toroids in parallel magnetic fields.

B. S. Berry in U.S. Pat. No. 4,033,795 issued July 5, 1977 discloses a method for inducing magnetic anisotropy in an amorphous ferromagnetic alloy such as the amorphous ferromagnetic material $Fe_{75}P_{15}C_{10}$. The change in Young's modulus of elasticity with applied magnetic field is enhanced by annealing in a magnetic field in the transverse direction and is diminished by annealing in the longitudinal direction.

F. Pfeifer et al. in Journal of Magnetism and Magnetic Materials 6, 80–83 (1977) disclose that magnetic annealing of glassy $Fe_{40}Ni_{40}P_{14}B_6$ alloy may result in high static permeabilities.

SUMMARY OF THE INVENTION

In accordance with the present invention a magnetic glassy metal alloy sheet is annealed in a magnetic field oriented substantially normal to the sheet surface at an elevated temperature. The magnetic field applied is sufficiently strong to induce a magnetization inside the sheet essentially in said direction. A second weaker magnetic field may be applied in a direction substantially normal to the first field simultaneously with the first field or successively at a lower temperature. The second field may be applied one or more additional times.

The annealed alloy sheet of the invention comprises a sheet of at least one glassy metal alloy, preferably having a permeability of at least about 1000 at low induction. Low induction is an induction of from about 10 to 100 Gauss. Permeability as employed herein means relative permeability. The relative permeability is the ratio of the inductance in the medium to the inductance in vacuum.

These alloy sheets have low hysteresis losses and are eminently suitable as transformer cores. The coefficient of the parallel to the sheet plane contribution to the free magnetic energy density of the alloy sheets is preferably about equal to the coefficient of the normal contribution to the free magnetic energy density. In another preferred embodiment the easy magnetic axis is substantially normal to the sheet plane.

Preferably, the glassy metal alloy consists essentially of about 70 to 90 atom percent of at least one metal selected from the group consisting of iron and cobalt, up to about three-fourths of which may be replaced by nickel and up to about one quarter of which may be replaced by one or more metal selected from the group consisting of vanadium, chromium, manganese, copper, molybdenum, niobium, tantalum, tungsten, and the balance at least one metalloid selected from the group consisting of boron, carbon and phosphorus, up to about three-fifths of which may be replaced by silicon and up to about one-third of which may be replaced by aluminum, plus incidental impurities.

DETAILED DESCRIPTION OF THE INVENTION

Figure 1:
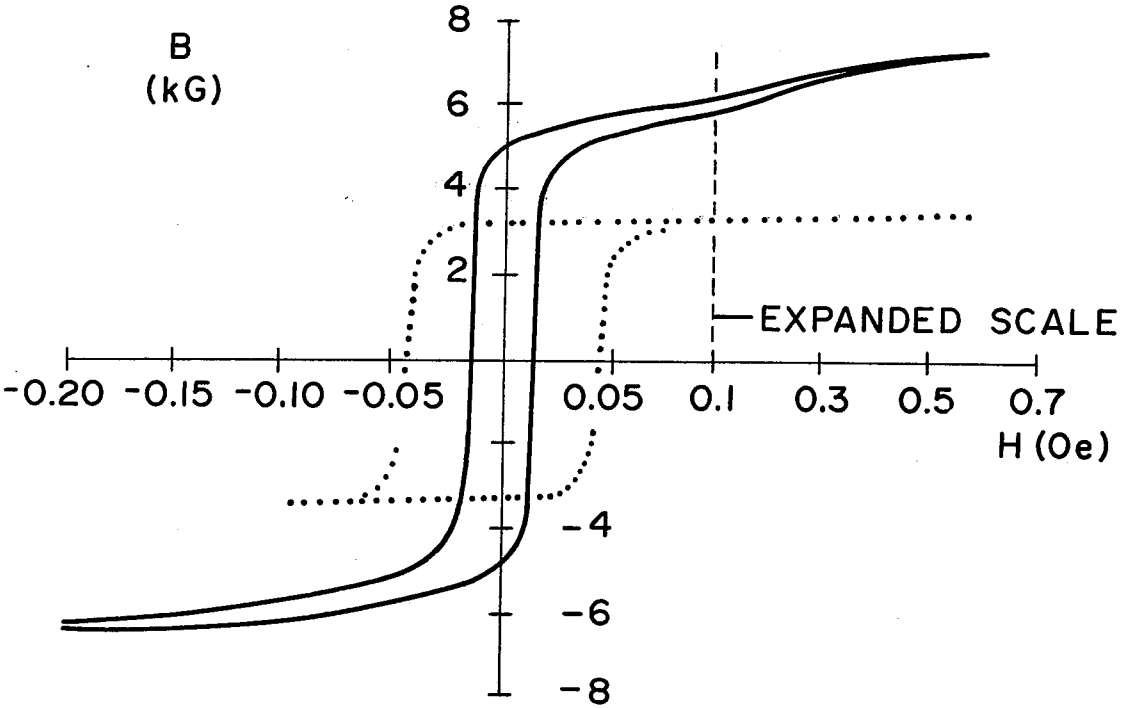
FIG. 1 shows a diagram of static B-H loops for annealed tape wound core of 5.4 cm wide $Fe_{40}Ni_{40}P_{14}B_6$ glass alloy.

A magnetic glassy metal alloy sheet is annealed at an elevated temperature in a magnetic field directed substantially normal to the sheet surface, the magnetic field being sufficiently strong to induce a magnetization inside the sheet essentially in said direction. It is preferred that such field saturates the magnetic alloy.

Preferably a weaker magnetic field substantially normal to the first field is concurrently employed with the first field at the selected elevated temperature or successively employed at temperatures between about 25° C. and 100° C. below the elevated temperature.

The term "glassy", as used herein, means a state of matter in which the component atoms are arranged in a disorderly array; that is, there is no long range order. Such a glassy material gives rise to broad, diffuse diffraction peaks when subjected to electromagnetic radiation having wavelengths in the X-ray region (about 0.01 to 50 Angstrom wavelength). This is in contrast to crystalline material, in which the component atoms are arranged in an orderly array, giving rise to sharp diffraction peaks. Primarily glassy material may include a minor amount of crystalline material. While the alloy is primarily glassy, it is preferred that it be substantially glassy in order to minimize the danger of growth of crystallites at high temperatures (above 200° C.), which would lead to a significant loss of soft magnetic properties.

It is intended that the magnetic glassy metal alloy sheet of the present invention include within its scope a plurality or an assembly of superposed sheets. A glassy metal alloy sheet, as fabricated, is generally relatively thin. Accordingly it is generally necessary to use such plurality or assembly of superposed sheets. The glassy metal alloy sheet includes sheet, ribbon, strip, film, foil, plate, layer. Such sheets can be obtained according to U.S. Pat. Nos. 3,862,658; 3,881,540; and 4,077,462 and Belgian Pat. No. 859,694 issued Oct. 13, 1978. Pertinent portions of the disclosures of these patents are incorporated herein by reference.

The glassy metal alloy sheet generally has a thickness of between about 0.02 mm and 0.1 mm and preferably between about 0.03 mm and 0.06 mm.

For obtaining compact ferromagnetic bodies a number of sheets can be laminated together. The resulting laminated bodies include bars, rods, cylindrical cores, horse shoe shaped cores and the like.

The magnetic glassy metal alloy sheets exhibit at sufficiently low temperature, specifically below the Curie temperature cooperative magnetic phenomena and in particular ferromagnetism.

The glassy metal alloys employed in production of the sheets consist essentially of about 70 to 90 atom percent of at least one metal selected from the group consisting of iron and cobalt, up to about three-fourths of which may be replaced by nickel and up to one quarter of which may be replaced by one or more metal selected from the group consisting of vanadium, chromium, manganese, copper, molybdenum, niobium, tantalum and tungsten, and the balance at least one metalloid selected from the group consisting of boron, carbon and phosphorus, up to about three-fifths of which may be replaced by silicon, and up to about one-third of which may be replaced by aluminum, plus incidental impurities. The partial replacement of iron and/or cobalt by nickel may result in higher permeability values. The partial replacement of the metalloid elements may be made in order to aid formation of the glassy filament during casting from the molten state and/or to improve its properties, including its magnetic properties.

The replacement by nickel of more than about three-fourths of the total amount of iron and/or cobalt tends to reduce the residual induction and hence the flux carrying capacity to unacceptably low levels. A preferred maximum replacement by nickel is about three-fifths of the total amount of iron and/or cobalt to maintain a reasonably high flux carrying capacity.

The glassy metal alloys include, without the partial replacement of metals and metalloids, compositions consisting essentially of about 70 to 90 atom percent of at least one of iron and cobalt and the balance at least one of boron, carbon and phosphorus. Examples include the following nominal compositions. $Fe_{80}B_{20}$, $Fe_{86}B_{14}$, $Co_{74}Fe_6B_{20}$, $Fe_{64}Co_{16}B_{20}$ and $Fe_{69}Co_{18}B_{13}$ (the subscripts are in atom percent). The glassy metal alloys also include, with maximum partial replacement of both metal and metalloid elements, compositions consisting essentially of about 19 to 22 atom percent of at least one of iron and cobalt, about 56 to 65 atom percent of nickel, about 9 to 17 atom percent of at least one of boron, carbon and phosphorus and about 4 to 8 atom percent of at least one of silicon and aluminum. Compositions intermediate the minimum and maximum replacement ranges, such as $Fe_{40}Ni_{40}P_{14}B_6$, $Ni_{50}Fe_{30}B_{20}$ and $Ni_{49}Fe_{29}P_{14}B_6Si_2$, are also included.

Up to about 10 atom percent of iron and/or cobalt may also be replaced by other transition metal elements which are commonly alloyed with iron and cobalt, without deleteriously affecting the desirable magnetic and mechanical properties of the glassy metal alloys employed in the invention. Such replacement may be made in order to obtain enhancement of specific properties, such as hardness, corrosion resistance, electrical resistivity and the like. Examples of such transition metal elements include chromium, molybdenum, copper, manganese, vanadium, niobium, tantalum and tungsten. Examples of glassy alloys suitably employed in the invention include the following nominal compositions: and tungsten. Examples of glassy alloys suitably employed in the invention include the following nominal compositions: $Fe_{63}Co_{15}Mo_2B_{20}$, $Fe_{40}Ni_{38}Mo_4B_{18}$, $Fe_{71}Mo_9C_{18}B_2$, $Fe_{37}Ni_{37}Cr_4B_{22}$, $Fe_{67}Ni_{10}Cr_3B_{20}$, $Fe_{78}Mo_2B_{20}$, and $Fe_{40}Ni_{38}Mo_4B_{18}$. Cobaltcontaining compositions of glassy alloys suitable for use in the soft ferromagnetic alloys of the present invention include those having the formula $Co_uFe_vNi_wM_z$ wherein M is boron, carbon, silicon or phosphorus, u is from about 40 to 80, v is from about 5 to 15, w is from about 10 to 50, and z is from about 15 to 20, all in atomic percent with the proviso that the sum of $u+v+w+z$ equals 100.

The constituent elements of nominal compositions may be varied a few atom percent without substantial change in properties. The purity of all compositions is that found in normal commercial practice.

At a given field strength, the higher the permeability of the glassy metal alloy, the greater the effectiveness as a soft magnetic material in magnetic applications such as transformer cores. Permeability as employed herein means relative permeability. The relative permeability is the ratio of the inductance in the medium to the inductance in vacuum. A permeability of at least about 1000 at low induction is considered desirable to develop practically useful soft magnetic materials. Low induction is an induction from about 10 to 100 Gauss. Such values may be achieved by proper selection of alloy composition and/or by suitable processing of the sheet.

Glassy metal alloys such as $Fe_{40}Ni_{40}P_{14}B_6$ and $Fe_{80}B_{20}$ have the advantage that they develop exceptionally high permeability as quenched during their processing. Details of the processing conditions and procedures to form glassy metal alloys are readily available; see, e.g. U.S. Pat. Nos. 3,856,513 and 3,845,805, issued Dec. 24, 1974 and issued Nov. 5, 1974, respectively.

The annealing fields employed in the present invention can be a first static magnetic field directed substantially normal to the sheet plane and a second weaker static magnetic field directed substantially parallel to the sheet plane. Alternating electromagnetic fields can also be employed at frequencies up to about 100 kHz. Furthermore the magnetic fields can be employed intermittently as pulsating fields.

The first magnetic field should be sufficient to induce a flux density of at least about one quarter of the saturation induction in the glassy magnetic alloy. Preferably, the applied first field is at least about 1.1 times the saturation induction in gauss of the magnetic glassy alloy at the elevated temperature of the first anneal. The first magnetic field should preferably be at least about 1000 oersteds. Application of the first magnetic field at the elevated temperature and cooling down in the field results in a sheet having an easy magnetic axis normal to the sheet plane.

Alternatively, in view of the relation $Hi=H-4\pi M$ wherein Hi is the internal magnetic field, H is the applied magnetic field and M is the magnetic induction in cgsemu units (H in Oersteds, M in Gauss), the internal field Hi should be at least about 1 Oersted.

The second magnetic field should be sufficient to essentially saturate the sheet in an in-plane direction. Preferably the in-plane direction of the second field is the direction of the flux of the magnetic fields employed in the applications of the sheet. In general, the second magnetic field can amount to between about 1 and 10 oersteds, can be used simultaneously with the first field at elevated temperature or subsequently at lower temperature.

In the embodiment wherein the first and second fields are employed sequentially, the application of the fields should preferably result essentially in a saturation in the respective direction. Sequential application of a first and second field can be achieved by pulsating fields staggered in time. Such pulses may last for a time of about 1 millisecond to one hour and preferably for a time of about 1 second to 1 minute.

The elevated temperature should preferably be below the glass transition temperature $T_g$ and be above about 225° C. The glass transition temperature $T_g$ is the temperature below which the viscosity of the glass exceeds $10^{14}$ poise.

The magnetic glassy alloy is field annealed in a first field at the elevated temperature generally for a time of between about 10 min. and 10 hours and preferably between about 1 and 2 hours. When the elevated temperature is very close to the glass transition temperature $T_g$, shorter annealing times can become appropriate. Under these conditions the first magnetic field should be present. The second magnetic field can optionally also be present. Then the magnetic glassy alloy is cooled with similar magnetic fields present at a rate of between about 0.1° C./min and 100° C./min. and preferably between 0.5° C./min and 5° C./min. During the cooling process the saturation induction of the metallic glassy alloy generally increases, but it is not required to change the magnetic fields when cooling according to the ranges given above. The annealing step indicated can be discontinued when a temperature of between about 100° C. and 250° C. and preferably between about 150° C. and 200° C. has been reached.

Preferably the second field is applied subsequently to the first field. The magnetic glassy metal alloy sheet is brought to a temperature between about 25° and 100° lower than the elevated temperature for a time of up to about 10 hours and preferably for a time up to about 1 hour. Then the glassy metal alloy sheet is cooled at a rate of between about 0.1° C./min and 100° C./min and preferably between about 0.5° C./min and 5° C. min. This step can be discontinued when a temperature between about 100° C. and 225° C. and preferably between 150° C. and 200° C. is reached.

The second annealing step can then be repeated one or more times under the conditions set forth above. Preferably, in the fabrication of transformer cores, the second annealing step is repeated until a minimum of the core loss is obtained. In general, such minimum is obtainable with less than about ten second anneals and usually within less than about three second anneals.

Wide tapes of Fe-Ni base glassy metal alloy sheets annealed in accordance with the present invention exhibit low-field magnetic properties comparable to those of conventional narrow glassy metal alloy ribbons of similar composition. In addition, ring-laminated cores, when field annealed, according to the present invention, show properties comparable to those of commercial permalloys and ferrites and the annealed glassy magnetic alloy sheet of the present invention can be employed where low magnetization losses are imperative such as for transformer cores.

A tapewound core is a coiled tape exhibiting essentially cylindrical symmetry and with the 2-dimensional tangent planes of the tape surface parallel to planes going through the cylinder axis.

A ring laminated core is a stack of circular planar rings exhibiting essentially cylinder symmetry with the 2-dimensional tangent planes of the rings normal to the cylinder axis.

Hp (parallel) for a tapewound core is directed in a direction within a tangential plane and which plane is at each point along the tape normal to the direction of the cylinder axis.

Hn (normal) for a tapewound core is directed in a direction normal to the tangential plane.

Hp (parallel) for a ring laminated core is directed within the tangential plane.

Hn (normal) for a ring laminate core is directed parallel to the cylinder axis.

A coordinate system is introduced for every point of a ring laminated core as follows: The x axis lies in the tangent space to the ring in a direction normal to the shortest connecting line between the point and the cylinder axis. Hp is aligned with the x axis. The y axis lies in the tangent space to the ring in the direction from the cylinder axis to the point. The z axis lies in a normal direction to the tangent plane and forms together with the x axis and y axis a right handed coordinate system. Hn is aligned with the z axis. In this space spherical coordinates are introduced by defining the coordinates of a vector of unit length of as follows:

x=sin (theta) cos (phi)
y=sin (theta) sin (phi)
z=cos (theta).

Within the ring laminated core a magnetic free energy density $F_M$ in erg/cm$^3$ can be defined.

$K_0$ is called the isotropic contribution to F in erg/cm$^3$.

$K_p$ is called the coefficient of the parallel contribution to $F_M$.

$K_n$ is called the coefficient of the normal contribution to $F_M$.

The following relation holds:

$$Fm = K_0 + K_p[\cos^2(\text{theta}) + \sin^2(\text{phi})] + K_n \sin^2(\text{theta}) + K_D \cos^2\theta.$$

The term $K_D \cos^2\theta$ represents demagnetization and shape anisotropy.

The optimum core loss and permeability in a material is present when $K_p$ is about equal to $K_n$. In this case $Fm = K_0 + K_p \sin^2\theta$ neglecting the $K_D$ term and spins do not have to surmount a potential barrier to swing out of plane as in a domain wall. However, a direct measurement of $K_p$ and $K_n$ is difficult.

Annealing in the first field directed normal to the sheet plane leads to $K_n > K_p$ and the B-H loop is sheared over. Repeated successive anneals in the second field increase the ratio $K_p/K_n$. At one point in such sequence a core loss minimum is observed and $K_p/K_n$ is about 1. Annealing magnetic alloy glasses for obtaining $K_pK_n$ about equal to 1 depends on numerous variables such as the Curie temperature, $T_c$, the saturation magnetization 4 Ms, the sample shape, the susceptibility to field annealing, heating and cooling rates, anneal temperature $T_A$, crystallization temperature $T_x$, glass transition temperature $T_g$ and applied field.

The magnetization losses and permeabilities of metallic glasses are improved by introducing more domain walls. The absence of grain boundaries in these noncrystalline materials makes control of domain size through grain size impossible. However, reducing the energy density of the domain walls in a given sample provides for an equilibrium configuration containing more domain walls. One way of lowering the domain wall energy density is to field-induce an easy axis in the direction that the magnetization takes at the center of the domain wall i.e. perpendicular to the plane of the sample. This is not readily accomplished for a tape-wound core, but is easily achieved in a ring-laminated core using permanent magnets for generating $H_n$ in addition to the circumferential field, $H_p$.

By varying the relative magnitude of the two induced anisotropies ($K_n$ and $K_p$, respectively) a condition condition is achieved which optimizes low-field properties.

Practically, annealing should take place in a strong field directed normal to the sheet plane (H larger or about equal to $4\pi$ Ms($T_A$)) and then step by step $K_p$ should be increased. The sample should pass through optimum core loss values if initially $K_p/K_n<1$ and finally $K_p/K_n>1$.

EXAMPLE 1

Preparation of Samples

Several tape-wound toroids were fabricated from 5.4 cm wide strips of $Fe_{40}Ni_{40}P_{14}B_6$ glassy alloy. They were annealed at 325° C. for two hours, then cooled at a rate of approximately 1° C./min in a 10 Oe circumferential field. Results for one such core, 3.2 cm O.D. Weighing 12.5 gms, are described below. Tape-wound cores were also prepared from wide strips of $Fe_{40}Ni_{40}B_{20}$ glassy metal alloy. They were field annealed at temperatures from 350°-380° C.

Several ring-laminated, toroidal cores were assembled from annular punchings from a 2 cm wide strip of $Fe_{40}Ni_{40}B_{20}$ glassy alloy. These cores were subjected to a variety of field-annealing conditions. Results for one such ring-laminated core, 1 cm I.D., 1.7 cm O.D., and weighing 3.6 gms will be described.

The glassy metal alloys $Fe_{40}Ni_{40}P_{14}B_6$ and $Fe_{40}Ni_{40}B_{20}$ exhibit the following properties: specific magnetization (emu/gm): 84, 103; density (gm/cm$^3$): 7.5,7.7, saturation magnetization $4\pi$ M (kG): 7.9,10.0; Curie temperature $T_c$ (° C.): 247,395; and crystallization temperature T (° C.): 380.389.

In addition to a simple circumferential field anneal, some of the ring-laminated cores were subjected to a magnetic field normal to the sheet planes.

EXAMPLE 2

Standard Magnetic Field Anneals of $Fe_{40}Ni_{40}P_{14}B_6$ Alloy

A B-H loop is a tracing of the magnetic induction versus the applied magnetic field H for a material showing cooperative magnetic effects. The B-H loop of the field-annealed, tape-wound core of 5.4 cm wide $Fe_{40}Ni_{40}P_{14}B_6$ glassy alloy is shown by the solid curve in FIG. 1. The parallel field $H_p$ in circumferential direction is called $H_c$. Here $H_{max}$ is 0.6 Oe and $H_c$ is 0.014 Oe; when $H_{max}$ is 0.2 Oe, then $H_c$ is 0.0125 Oe. A dramatic improvement with respect to the as-cast properties (dotted line, FIG. 1) is realized by field-annealing. The initial magnetization curve (field-annealed) reveals dc permeabilities at 20, 40, and 100 gauss of 7,500, 10,000, and 16,000 respectively.

The core loss for the $Fe_{40}Ni_{40}P_{14}B_6$ sample as annealed is well described over the frequency ranges $10^3$ smaller or about equal to f, smaller or about equal to $10^5$ Hz and $5\times10^2$ smaller or about equal to $B_m$, smaller or about equal to $3\times10^3$ gauss by the relation $$L=Af/B_m \quad (2)$$

A is a constant equal to $1.05\times10^{-10}$ for loss in watts/kg, f is the frequency, $B_m$ is the maximum induction, a=1.43 and b=1.59. Thus, at $B_m=10$ gauss and f=10 and 10 Hz, the core losses L were 0.12 and 3.2 watts/kg, respectively. These core loss values are comparable to best results for narrow ribbons of this glassy alloy and fall just above the range of values listed for commercial 80% Ni permalloys and for commercial ferrites.

EXAMPLE 3

Magnetic Field Anneals of $Fe_{40}Ni_{40}B_{20}$ Alloy

Field-annealed tape-wound cores of wide $Fe_{40}Ni_{40}B_{20}$ glass showed attractive low-field properties, typically $H_c=0.01$ Oe, $B_r=5400$ gauss. Ring-laminated cores of $Fe_{40}Ni_{40}B_{20}$ glass showed attractive dc magnetic properties coercive field $H_p$ smaller or about equal to 0.02 Oe and 6,000 smaller or about equal to remanent induction $B_r$ smaller or about equal to 9,000 gauss) after cooling from 350°-380° C. in a circumferential field. A sequence of crossed-field annealings with a magnetic field Hn, gave rise to the B-H loops shown in FIG. 2. Loop (a) was achieved by cooling from 360° C. at approximately 1° C./min in crossed-fields $H_p$ about equal to 1 Oe, $H_n$ about equal to 2000 Oe. Loops (b) to (d) were observed after one to three additional heat treatments (cooling from 270° C.) with only the circumferential field present.

Figure 3:
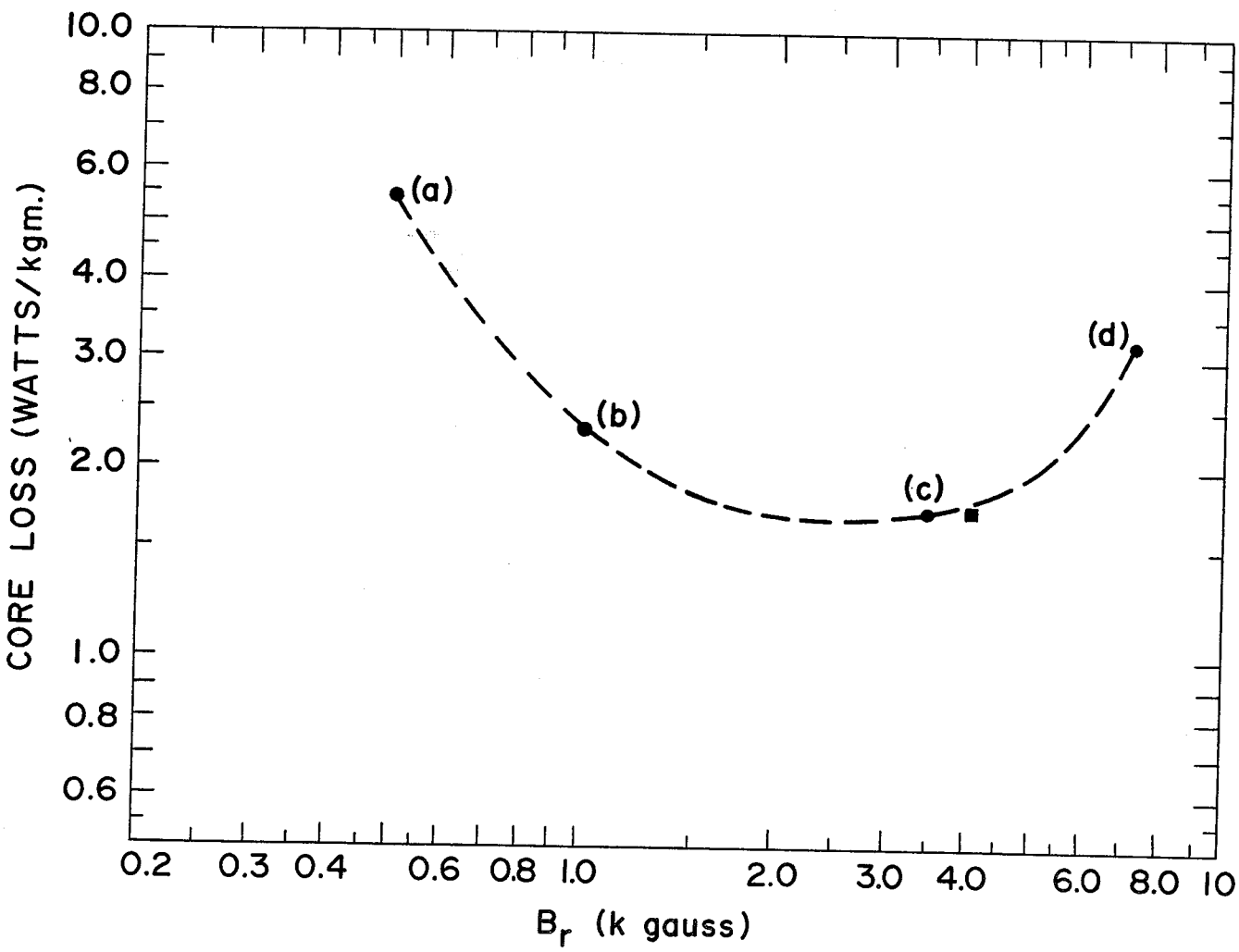
FIG. 3 shows a diagram of the core loss at $10^4$ Hz, $10^3$ gauss of the embodiments shown in FIG. 2.

The core loss at $10^4$ Hz, $10^3$ gauss, for this sequence of magnetic states is shown in FIG. 3 as a function of the remanence after each anneal. The square datum point is for a punched-ring sample cross-field annealed in one step $H_p=1$ Oe, $H_n=2000$ Oe.

For $B_r=3.5$ kG, the core loss at $10^4$ Hz is a minimum, indicating a favorable relation between $K_p$ and $K_n$. At lower (higher) frequencies, the minimum occurs at higher (lower) values of $B_r$. The core loss for the samples anneals to have $B_r=3.5$ kG are approximately described by Eq. 2 with $A=9\times10^{-12}$, a=1.5, and b=1.75. The loss observed at $10^4$ Hz, $10^3$ gauss, L=1.6 watts/kg, is the lowest value disclosed for this metallic glass. It falls within the range of values for various commercial permalloys and ferrites. Neither tape-wound cores nor ring-laminated cores of this composition annealed in a circumferential field $H_p$ only (showing $B_r$ in the range of 3.4–8.5 kG) have displayed core losses at $10^4$ Hz and $10^3$ gauss lower than 4 watts/kg.

Figure 2:
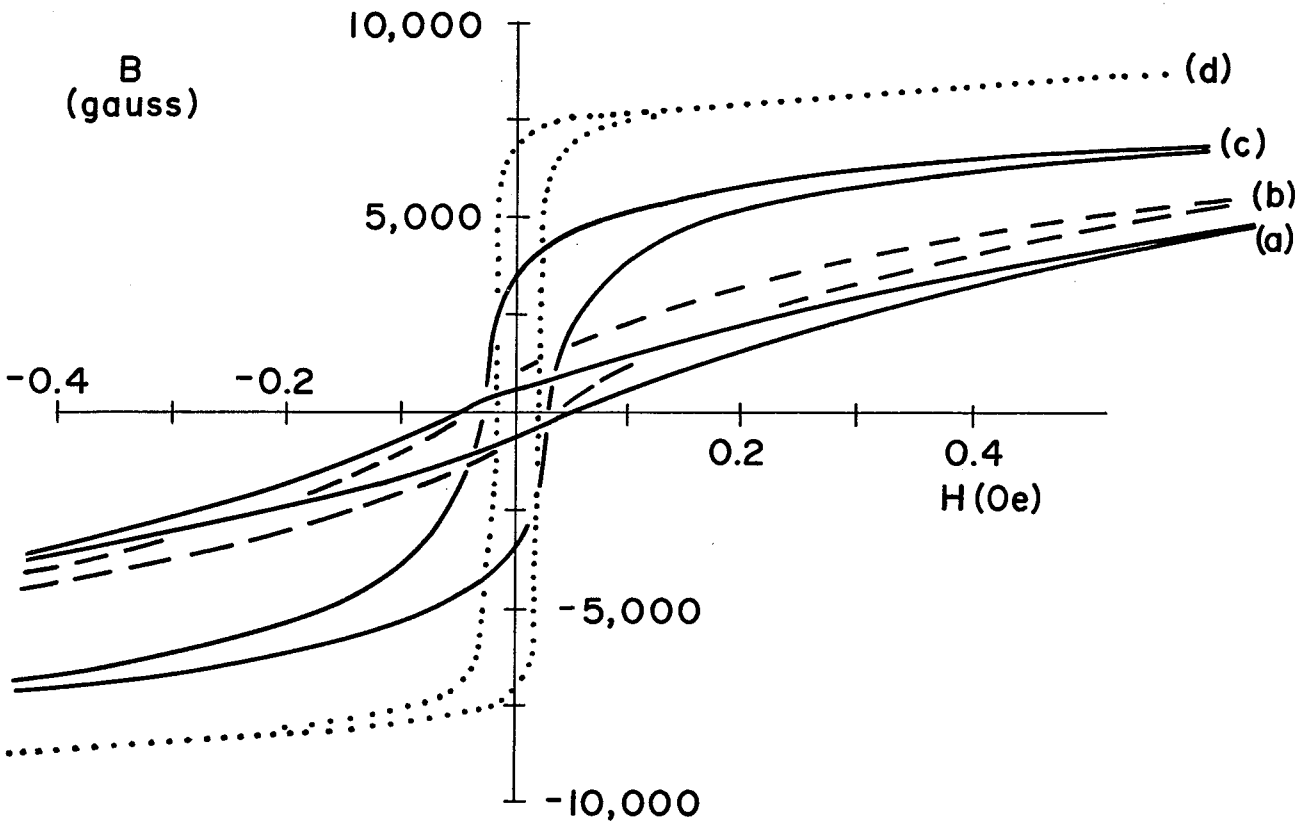
FIG. 2 shows a diagram of static B-H loops for punched cores of $Fe_{40}Ni_{40}B_{20}$ field annealed glassy alloys.
Figure 4:
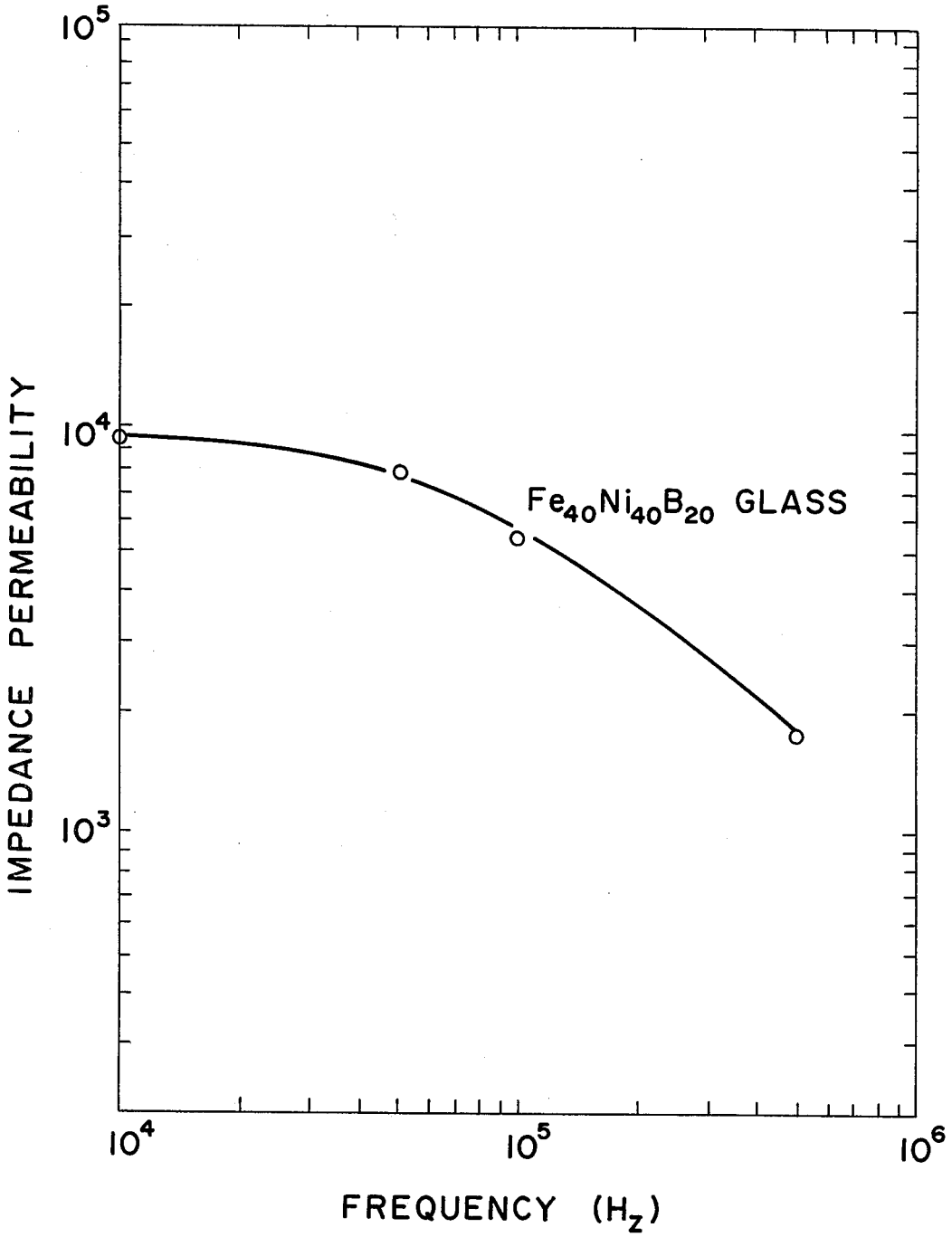
FIG. 4 shows a diagram of the impedance permeability at 100 gauss as measured on the ring laminated core annealed to state C of FIG. 3 and having the composition $Fe_{40}Ni_{40}B_{20}$.

The impedance permeability at 100 gauss of sample (c) in FIGS. 2 and 3 is 9800 at 10 Hz (more than twice that of MN30 Mn-Zn Ferrite) and decreases with increasing frequency slower than does that measured on a standard core of 4–79 Mo-Permalloy. Above 50 kHz the metallic glass shows higher permeability than the permalloy core as can be seen from FIG. 4.

We claim:

1. In a method of annealing a magnetic glassy metal alloy sheet by heat treatment in a magnetic field, the improvement comprising applying a magnetic field of at least about 1,000 Oersteds at an elevated temperature ranging from above about 225° C. to below the glass transition temperature of said metal alloy in a direction substantially normal to the sheet surface to induce a magnetization inside the sheet essentially in said direction, whereby said alloy remains glassy after said annealing.

2. The improvement in a method as set forth in claim 1 wherein the glassy metal alloy sheet has a permeability of at least about 1,000 at an induction of from about 10 to 100 Gauss.

3. The improvement in a method as set forth in claim 2 further comprising applying sequentially a second magnetic field weaker than the first field in a direction substantially normal to the first field.

4. The improvement in a method as set forth in claim 3 wherein the fields are pulsating with the first and second field pulses staggered in time.

5. The improvement in a method as set forth in claim 3 wherein the second field is applied successively to the first field.

6. The improvement in a method as set forth in claim 5 wherein the application of the second field is repeated.

7. The improvement in a method as set forth in claim 5 wherein the second field is applied at a temperature between about 25° C. and 100° C. lower than the elevated temperature.

8. The improvement in a method as set forth in claim 7 wherein the temperature employed during application of the second field is lowered at a rate of between about 10° C./min and 1° C./hour.

9. The improvement in a method as set forth in claim 3 wherein the strength of the second magnetic field is at least about 0.1 oersted.

10. The improvement in a method as set forth in claim 9 wherein the strength of the second magnetic field is between about 1 and 10 oersteds.

11. The improvement in a method as set forth in claim 1 wherein the elevated temperature is above said Curie temperature of the glassy metal alloy employed.

12. The improvement in a method as set forth in claim 1 wherein the magnetic field in oersteds is at least about 1.1 times of the saturation induction in Gauss of the magnetic glassy alloy at the elevated temperature.

13. The improvement in a method as set forth in claim 1 wherein the applied magnetic field induces an internal magnetic field of at least about 1 Oersted in the magnetic glassy metal.

14. The improvement in a method as set forth in claim 1 wherein the glassy metal alloy sheet consists essentially of about 70 to 90 atom percent of at least one metal selected from the group consisting of iron and cobalt, up to about $\frac{3}{4}$ of which may be replaced by nickel, and up to one quarter of which may be replaced by at least one metal selected from the group consisting of vanadium, chromium, manganese, copper, molybdenum, niobium, tantalum and tungsten, and the balance at least one metalloid selected from the group consisting of boron, carbon and phosphorus, up to about 3/5 of which may be replaced by silicon, and up to about $\frac{1}{3}$ of which may be replaced by aluminum, plus incidental impurities.

15. A magnetic glassy metal alloy sheet produced by the method of claim 1, wherein the coefficient of the parallel contribution to the free magnetic energy density is about equal to the coefficient of the normal contribution to the free magnetic energy density, said sheet consisting essentially of about 70 to 90 atom percent of at least one metal selected from the group consisting of iron and cobalt, up to about $\frac{3}{4}$ of which may be replaced by nickel, and up to $\frac{1}{4}$ of which may be replaced by at least one metal selected from the group consisting of vanadium, chromium, maganese, copper, molybdenum, niobium, tantalum and tungsten, and the balance at least one metalloid selected from the group consisting of boron, carbon and phosphorus, up to about 3/5 of which may be replaced by silicon and up to about $\frac{1}{3}$ of which may be replaced by aluminum plus incidental impurities.

* * * * *